US011417285B2

(12) United States Patent
Sun et al.

(10) Patent No.: US 11,417,285 B2
(45) Date of Patent: Aug. 16, 2022

(54) METHOD FOR CONTROLLING BACKLIGHT, BACKLIGHT CONTROLLER OF DISPLAY DEVICE, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Yilang Sun, Beijing (CN); Tiankuo Shi, Beijing (CN); Zhihua Ji, Beijing (CN); Xiaomang Zhang, Beijing (CN); Yifan Hou, Beijing (CN)

(73) Assignees: Beijing BOE Optoelectronics Technology Co., LTD., Beijing (CN); BOE Technology Group Co., LTD, Beijing (CN)

( * ) Notice: Subject to any disclaimer, the term of this patent is extended or adjusted under 35 U.S.C. 154(b) by 161 days.

(21) Appl. No.: 16/959,201

(22) PCT Filed: Dec. 17, 2019

(86) PCT No.: PCT/CN2019/125809

§ 371 (c)(1),
(2) Date: Jun. 30, 2020

(87) PCT Pub. No.: WO2020/164304

PCT Pub. Date: Aug. 20, 2020

(65) Prior Publication Data

US 2021/0217370 A1 Jul. 15, 2021

(30) Foreign Application Priority Data

Feb. 15, 2019 (CN) ..... 201910116473.0

(51) Int. Cl.
*G09G 3/34* (2006.01)

(52) U.S. Cl.
CPC ... *G09G 3/3426* (2013.01); *G09G 2320/0233* (2013.01); *G09G 2320/0626* (2013.01); *G09G 2360/16* (2013.01)

(58) Field of Classification Search
CPC ..... G09G 2320/0626; G09G 2360/16; G09G 2320/0233; G09G 3/34–3426
See application file for complete search history.

(56) References Cited

U.S. PATENT DOCUMENTS

2008/0284719 A1* 11/2008 Yoshida ..... H01L 27/12 349/37
2009/0109165 A1* 4/2009 Park ..... G09G 3/3426 345/589

(Continued)

FOREIGN PATENT DOCUMENTS

CN 101777312 A 7/2010
CN 101852946 A 10/2010

(Continued)

OTHER PUBLICATIONS

International search report of PCT application No. PCT/CN2019/125809 dated Mar. 19, 2020.

(Continued)

*Primary Examiner* — Roberto W Flores
(74) *Attorney, Agent, or Firm* — Fay Sharpe LLP

(57) ABSTRACT

Provided are a method for controlling backlight of a display device, a backlight controller for a display device, and a display device. The method includes: identifying a light emission luminance of each backlight partition in a backlight module according to display luminances of the plurality of display partitions; when the plurality of backlight partitions include two adjacent backlight partitions and an absolute value of a difference between the light emission luminance of the two adjacent backlight partitions is greater than a target threshold, adjusting the light emission lumi- (Continued)

nance of at least one of the two adjacent backlight partitions such that the absolute value of the difference between the light emission luminances of the two adjacent backlight partitions is decreased; and after the luminance is adjusted, controlling light-emitting of each backlight partition.

16 Claims, 11 Drawing Sheets

(56) References Cited

U.S. PATENT DOCUMENTS

| | | | | |
|---|---|---|---|---|
| 2009/0140975 | A1* | 6/2009 | Nonaka | G09G 3/3426 345/102 |
| 2009/0267879 | A1 | 10/2009 | Masuda | |
| 2010/0253696 | A1 | 10/2010 | Choi | |
| 2012/0081407 | A1 | 4/2012 | Chiou et al. | |
| 2013/0321491 | A1* | 12/2013 | Heishi | G09G 3/3426 345/690 |
| 2014/0022271 | A1 | 1/2014 | Lin et al. | |
| 2017/0084232 | A1 | 3/2017 | Yang et al. | |
| 2020/0082769 | A1 | 3/2020 | Sun et al. | |
| 2021/0366411 | A1* | 11/2021 | Yang | G09G 5/026 |

FOREIGN PATENT DOCUMENTS

| | | | |
|---|---|---|---|
| CN | 102117600 | A | 7/2011 |
| CN | 102800297 | A | 11/2012 |
| CN | 103050095 | A | 4/2013 |
| CN | 105161064 | A | 12/2015 |
| CN | 106328071 | A | 1/2017 |
| CN | 106652925 | A | 5/2017 |
| CN | 107680542 | A | 2/2018 |
| CN | 109064979 | A | 12/2018 |
| CN | 109686321 | A | 4/2019 |
| JP | 2009204824 | A | 9/2009 |

OTHER PUBLICATIONS

First office action of Chinese application No. 201910116473.0 dated Mar. 17, 2020.

Xingfeng Chen, Research and Implementation of LCD TV area dynamic control LED backlight, Nov. 15, 2009, pp. 29-43.

* cited by examiner

| | | | | | | | | | | | | | | | | | | | | | | | |
|---|---|---|---|---|---|---|---|---|---|---|---|---|---|---|---|---|---|---|---|---|---|---|---|
| 13 | 13 | 14 | 15 | 14 | 15 | 15 | 16 | 14 | 14 | 25 | 214 | 214 | 97 | 214 | 77 | 51 | 42 | 38 | 13 | 191 | 214 | 214 | 12 |
| 12 | 13 | 14 | 13 | 13 | 13 | 14 | 42 | 22 | 23 | 214 | 134 | 214 | 214 | 37 | 43 | 55 | 42 | 37 | 14 | 12 | 51 | 14 | 13 |
| 12 | 12 | 12 | 13 | 27 | 40 | 40 | 31 | 22 | 23 | 214 | 33 | 30 | 36 | 214 | 80 | 214 | 45 | 42 | 14 | 10 | 12 | 13 | 14 |
| 11 | 42 | 28 | 24 | 25 | 29 | 28 | 24 | 23 | 214 | 39 | 214 | 214 | 116 | 214 | 49 | 63 | 44 | 42 | 13 | 10 | 12 | 13 | 13 |
| 45 | 37 | 16 | 36 | 23 | 27 | 31 | 32 | 26 | 25 | 214 | 40 | 214 | 50 | 114 | 214 | 204 | 28 | 35 | 15 | 10 | 12 | 40 | 80 |
| 41 | 21 | 31 | 36 | 31 | 35 | 47 | 42 | 47 | 43 | 214 | 214 | 126 | 214 | 89 | 112 | 104 | 34 | 31 | 16 | 11 | 11 | 44 | 48 |
| 36 | 15 | 49 | 46 | 43 | 51 | 40 | 40 | 38 | 36 | 36 | 28 | 214 | 24 | 21 | 20 | 34 | 39 | 32 | 17 | 11 | 11 | 12 | 13 |
| 14 | 51 | 50 | 51 | 48 | 47 | 34 | 21 | 21 | 21 | 19 | 23 | 128 | 33 | 71 | 35 | 30 | 42 | 33 | 19 | 11 | 10 | 152 | 185 |

01

FIG. 4

| | | | | | | | | | | | | | | | | | | | | | | | |
|---|---|---|---|---|---|---|---|---|---|---|---|---|---|---|---|---|---|---|---|---|---|---|---|
| 29 | 49 | 69 | 89 | 109 | 129 | 149 | 149 | 169 | 189 | 190 | 214 | 214 | 197 | 214 | 195 | 173 | 172 | 172 | 169 | 207 | 214 | 214 | 189 |
| 29 | 49 | 69 | 89 | 109 | 129 | 149 | 172 | 170 | 190 | 214 | 201 | 214 | 214 | 192 | 192 | 193 | 192 | 172 | 169 | 189 | 193 | 189 | 189 |
| 29 | 49 | 69 | 89 | 111 | 132 | 152 | 171 | 190 | 190 | 214 | 191 | 191 | 191 | 214 | 196 | 214 | 192 | 172 | 169 | 169 | 169 | 169 | 169 |
| 29 | 52 | 71 | 90 | 110 | 131 | 151 | 170 | 190 | 214 | 192 | 214 | 214 | 199 | 214 | 193 | 194 | 192 | 172 | 149 | 149 | 149 | 149 | 149 |
| 32 | 52 | 69 | 91 | 110 | 131 | 151 | 171 | 190 | 190 | 214 | 192 | 214 | 193 | 199 | 214 | 208 | 171 | 171 | 149 | 129 | 129 | 132 | 136 |
| 32 | 50 | 71 | 91 | 111 | 131 | 152 | 172 | 172 | 192 | 214 | 214 | 200 | 214 | 197 | 199 | 198 | 171 | 151 | 149 | 129 | 109 | 112 | 113 |
| 31 | 49 | 73 | 92 | 112 | 133 | 152 | 152 | 172 | 191 | 191 | 191 | 214 | 190 | 190 | 170 | 171 | 172 | 151 | 130 | 129 | 109 | 89 | 89 |
| 29 | 53 | 73 | 93 | 113 | 132 | 131 | 150 | 170 | 170 | 170 | 190 | 200 | 191 | 175 | 171 | 151 | 152 | 151 | 130 | 109 | 109 | 133 | 126 |

01

FIG. 8

01

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 255 | 255 | 255 | 255 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

FIG. 9

METHOD FOR CONTROLLING BACKLIGHT, BACKLIGHT CONTROLLER OF DISPLAY DEVICE, AND DISPLAY DEVICE

This disclosure is a 371 of PCT Application No. PCT/CN2019/125809 filed Dec. 17, 2019, which claims priority to Chinese Patent Application No. 201910116473.0, filed on Feb. 15, 2019, and entitled "METHOD FOR CONTROLLING BACKLIGHT, BACKLIGHT CONTROLLER OF DISPLAY DEVICE, AND DISPLAY DEVICE", the entire contents of which are incorporated herein by reference.

This disclosure claims priority to Chinese Patent Application No. 201910116473.0, filed on Feb. 15, 2019, and entitled "METHOD FOR CONTROLLING BACKLIGHT, BACKLIGHT CONTROLLER OF DISPLAY DEVICE, AND DISPLAY DEVICE", the entire contents of which are incorporated herein by reference.

TECHNICAL FIELD

The present disclosure relates to a method for controlling a backlight, a backlight controller of a display device, and a display device.

BACKGROUND

Liquid crystal display devices are widely used in electronic products such as televisions and mobile phones due to their advantages of low radiation, low power consumption, and small size.

SUMMARY

The present disclosure provides a method for controlling a backlight, a backlight controller of a display device, and a display device. The technical solutions are as follows:

In one aspect, a method for controlling backlight of a display device is provided. The display device includes: a display panel and a backlight module, wherein the display panel includes a plurality of display partitions, and the backlight module includes a plurality of backlight partitions one-to-one corresponding to the plurality of display partitions. The method includes:

identifying a light emission luminance of each backlight partition in the backlight module according to display luminances of the plurality of display partitions;

when the plurality of backlight partitions include two adjacent backlight partitions, and an absolute value of a difference between the light emission luminance of the two adjacent backlight partitions is greater than a target threshold, adjusting the light emission luminance of at least one of the two adjacent backlight partitions to decrease the absolute value of the difference between the light emission luminances of the two adjacent backlight partitions; and controlling light-emitting of each of the backlight partitions after the adjusting of the light emission luminance is completed.

Optionally, adjusting the light emission luminance of the at least one of the two adjacent backlight partitions to decrease the absolute value of the difference between the light emission luminances of the two adjacent backlight partitions includes:

adjusting the light emission luminance of the at least one of the two adjacent backlight partitions to make the absolute value of the difference between the light emission luminances of the two adjacent backlight partitions be less than or equal to the target threshold.

Optionally, when the plurality of backlight partitions includes the two adjacent backlight partitions, and the absolute value of the difference between the light emission luminances of the two adjacent backlight partitions is greater than the target threshold, adjusting the light emission luminance of the at least one of the two adjacent backlight partitions includes:

by taking a backlight partition with the highest luminance in the plurality of backlight partitions as a center backlight partition, performing an adjustment process, wherein the adjustment process includes:

when the adjacent backlight partitions of the center backlight partition include a partition to be adjusted, and an absolute value of a difference between the light emission luminance of the center backlight partition and that of the partition to be adjusted is greater than the target threshold, adjusting the light emission luminance of the partition to be adjusted, to decrease the absolute value of the difference between the light emission luminance of the center backlight partition and that of the partition to be adjusted; and after the light emission luminance is adjusted, when the difference between the light emission luminance of at least one of the partition to be adjusted and a non-zero minimum luminance is greater than the target threshold, updating the center backlight partition to the partition to be adjusted, and repeating the adjustment process until the difference between the light emission luminance of each partition of the partition to be adjusted, after the light emission luminance is adjusted, and the non-zero minimum luminance is less than or equal to the target threshold, wherein the non-zero minimum luminance is: a non-zero minimum luminance of the light emission luminances of the plurality of backlight partitions before the light emission luminance of the at least one of the two adjacent backlight partitions is adjusted.

Optionally, adjusting the light emission luminance of the partition to be adjusted includes:

when the difference between the luminance of the center backlight partition and that of the partition to be adjusted is greater than the target threshold, adjusting the luminance of the partition to be adjusted to a difference between the light emission luminance of the center backlight partition and the threshold value; and when the difference between the light emission luminance of the center backlight partition and that of the partition to be adjusted is less than or equal to the target threshold, and the difference between the light emission luminance of the partition to be adjusted and that of the center backlight partition is greater than the threshold value, adjusting the light emission luminance of the partition to be adjusted to a sum of the light emission luminance of the center backlight partition and the threshold value.

Optionally, the adjustment process further includes: performing luminance scanning for each of the adjacent backlight partitions of the center backlight partition to identify whether each of the adjacent backlight partitions of the center backlight partition is the partition to be adjusted;

after adjusting the light emission luminance of the at least one of the two adjacent backlight partitions, the method further includes:

when the luminance scanning is not performed for at least one of the plurality of backlight partitions, if the plurality of backlight partitions include two adjacent backlight partitions, and an absolute value of the difference between the light emission luminances of the two adjacent backlight partitions is greater than the target threshold, adjusting the light emission luminance of the at least one of the two adjacent backlight partitions to decrease the absolute value of the difference between the light emission luminances of the two adjacent backlight partitions.

Optionally, the plurality of backlight partitions include backlight partitions in m rows and n columns, $m \geq 1$, $n \geq 1$, and the method further includes:

acquiring a flag matrix in m rows and n columns, wherein each element of the flag matrix is not zero;

when performing luminance scanning for the backlight partition in an $i^{th}$ row and a $j^{th}$ column, assigning the element in the $i^{th}$ row and the $j^{th}$ column of the flag matrix to a value of 0, $1 \leq i \leq m$, $1 \leq j \leq n$; and when there is a non-zero element in the flag matrix, identifying that the luminance scanning is not performed for at least one of the plurality of backlight partitions.

Optionally, the method further includes:

when the luminance scanning is performed for all the backlight partitions, if the light emission luminances of the plurality of backlight partitions are not adjusted, the light emission luminance of a $k^{th}$ adjacent backlight partition of a $p^{th}$ backlight partition is greater than the light emission luminance of the $p^{th}$ backlight partition, increasing the light emission luminance of the $k^{th}$ adjacent backlight partition by a first luminance, $p \geq 1$, $k \geq 1$; and when the luminance scanning is performed for all the backlight partitions, if the light emission luminances of the plurality of backlight partitions are not adjusted, the light emission luminance of the $k^{th}$ adjacent backlight partition is less than or equal to the light emission luminance of the $p^{th}$ backlight partition, decreasing the light emission luminance of the $k^{th}$ adjacent backlight partition by a first luminance;

wherein the first luminance $$\Delta Lk = \frac{(Lk - Lp) * Q2}{Lx - Ly},$$

Lk represents the light emission luminance of the $k^{th}$ adjacent backlight partition when the light emission luminances of the plurality of backlight partitions are not adjusted, Lp represents the light emission luminance of the $p^{th}$ backlight partition when the light emission luminances of the plurality of backlight partitions are not adjusted, Q2 represents an auxiliary threshold, Lx represents the maximum luminance, and Ly represents the non-zero minimum luminance.

Optionally, the method further includes:

before adjusting the light emission luminance of at least one of the two adjacent backlight partitions, identifying a max luminance and a non-zero minimum luminance of the light emission luminances of the plurality of backlight partitions;

wherein when the plurality of backlight partitions includes the two adjacent backlight partitions, and the absolute value of the difference between light emission luminance of the two adjacent backlight partitions is greater than the target threshold, adjusting the light emission luminance of at least one of the two adjacent backlight partitions includes:

when the maximum luminance is not equal to the non-zero minimum luminance, and the plurality of backlight partitions include two adjacent backlight partitions, and an absolute value of a difference between the light emission luminances of the two adjacent backlight partitions is greater than a target threshold, adjusting the light emission luminance of the at least one of the two adjacent backlight partitions.

Optionally, the adjacent backlight partitions of the center backlight partition are: backlight partitions adjacent to the center backlight partition in eight directions of the center backlight partition.

Optionally, a sum of the target threshold and the auxiliary threshold is less than or equal to a luminance of 40 grayscales.

Optionally, each element of the flag matrix is equal to 1.

In another aspect, a backlight controller for a display device is provided. The display device further includes: a display panel and a backlight module, wherein the display panel includes a plurality of display partitions, and the backlight module includes a plurality of backlight partitions one-to-one corresponding to the plurality of display partitions. The backlight controller includes:

a first identifying module, configured to identify a light emission luminance of each backlight partition in the backlight module according to display luminances of the plurality of display partitions;

a first adjusting module, configured to, when the plurality of backlight partitions include two adjacent backlight partitions, and an absolute value of a difference between light emission luminances of two adjacent backlight partitions is greater than a target threshold, adjust the light emission luminance of at least one of the two adjacent backlight partitions to decrease the absolute value of the difference between the light emission luminances of the two adjacent backlight partitions; and a control module, configured to control, after the light emission luminance is adjusted, light-emitting of each of the backlight partitions.

In yet another aspect, a backlight controller for a display device is provided. The backlight controller includes: a processor and a storage medium;

wherein the storage medium is configured to store at least one computer instruction executable by the processor, the at least one computer instruction, when executed by the processor, enabling the processor to perform the method for controlling the backlight of the display device as described above.

In still another aspect, a storage medium is provided. The storage medium stores thereon at least one computer instruction executable by a processor; wherein the at least one computer instruction, when executed by the processor, enables the processor to perform the method for controlling the backlight of the display device as described above.

In still another aspect, a display device is provided. The display device includes: a display panel, a backlight module, and a backlight controller; wherein the backlight controller is the backlight controller for the display device as described above.

BRIEF DESCRIPTION OF THE DRAWINGS

FIG. 4 is a schematic diagram of a light emission luminance of a backlight partition according to an embodiment of the present disclosure;

FIG. 8 is a schematic diagram of a light emission luminance of another backlight partition according to an embodiment of the present disclosure;

FIG. 9 is a schematic diagram of a light emission luminance of another backlight partition according to an embodiment of the present disclosure;

DETAILED DESCRIPTION

For clearer descriptions of the principles, technical solutions and advantages in the present disclosure, the present disclosure is described in detail below in combination with the accompanying drawings.

Figure 1:
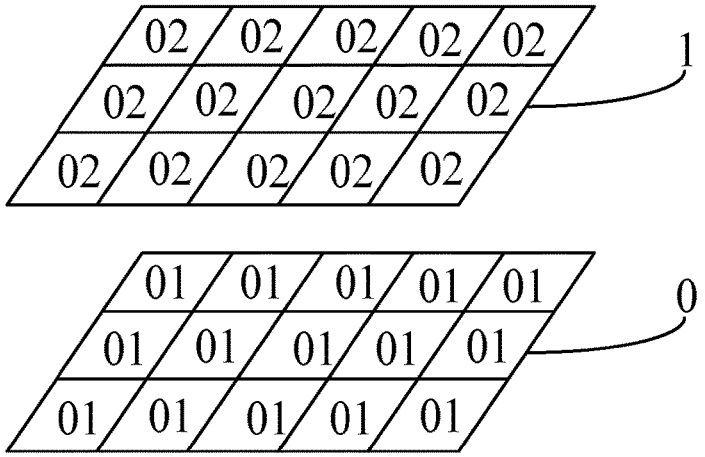
FIG. 1 is a schematic diagram of a backlight partition and a display partition according to an embodiment of the present disclosure.

The display device generally includes: a display panel, a backlight module for providing a backlight to the display panel, and a backlight controller for controlling light-emitting of the backlight module. Specifically, as illustrated in FIG. 1, the backlight module 0 can be divided into a plurality of backlight partitions 01, and the display panel 1 can be divided into a plurality of display partitions 02. A plurality of backlight partitions 01 are in a one-to-one correspondence with the plurality of display partitions 02, each backlight partition 01 is used to provide a backlight for a display partition 02 corresponding to the backlight partition 01, and the backlight controller is used to control light-emitting of the backlight partition.

In the related art, when the backlight partition provides the backlight for the display panel, halation may appear in the display panel. A method for controlling a backlight is provided according to an embodiment of the present disclosure, and the backlight controller controls the light-emitting of the backlight partition based on the method for controlling the backlight to reduce the halation in the display panel.

Figure 2:
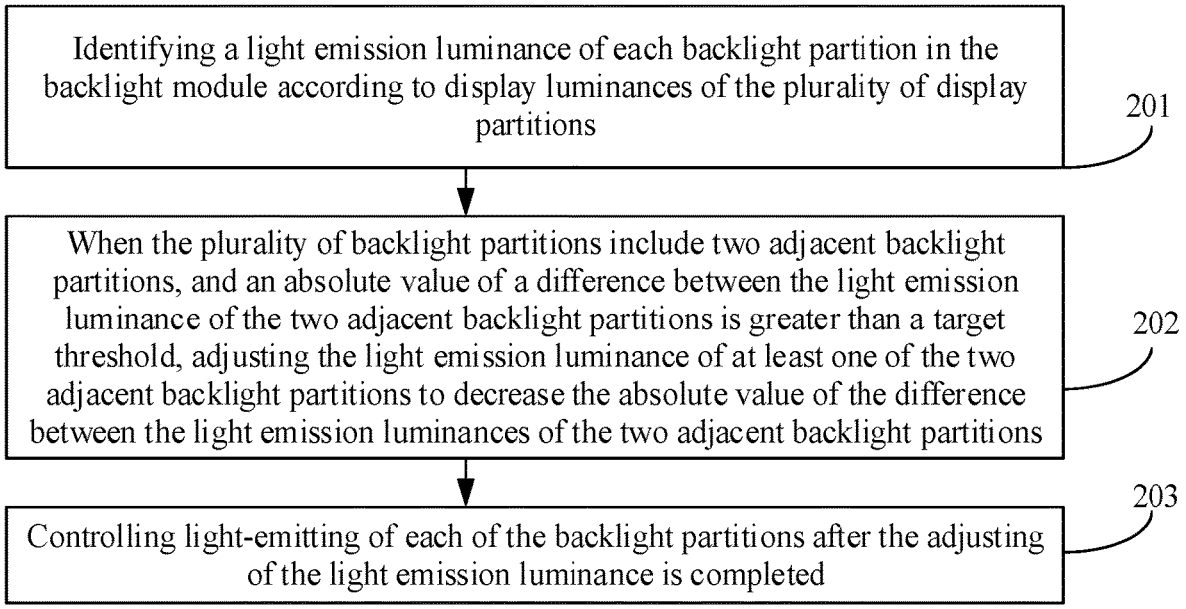
FIG. 2 is a flowchart of a method for controlling a backlight according to an embodiment of the present disclosure.

FIG. 2 is a flowchart of a method for controlling backlight of a display device according to an embodiment of the present disclosure. The display device includes: a display panel and a backlight module. As illustrated in FIG. 2, the method for controlling the backlight may include the following steps.

In step 201, a light emission luminance of each backlight partition in the backlight module is identified according to display luminances of a plurality of display partitions.

In step 202, when the plurality of backlight partitions include two adjacent backlight partitions, and an absolute value of a difference between the light emission luminance of the two adjacent backlight partitions is greater than a target threshold, the light emission luminance of at least one of the two adjacent backlight partitions is adjusted to decrease the absolute value of the difference between the light emission luminances of the two adjacent backlight partitions.

In step 203, light-emitting of each of the backlight partitions is controlled after the adjusting of the light emission luminance is completed.

In summary, in the method for controlling the backlight according to the embodiment of the present disclosure, the light emission luminance of the at least one backlight partition is adjusted, thereby minimizing the difference between the light emission luminance of the at least one backlight partition and that of the adjacent backlight partition. In addition, the smaller the difference between the light emission luminance of the backlight partition and that of the adjacent backlight partition is, the less obvious the halation in the display device is. Therefore, by decreasing the difference between the light emission luminances in the present disclosure, the halation in the display panel may be reduced, and thus the display effect of the display panel may be improved.

Figure 3:
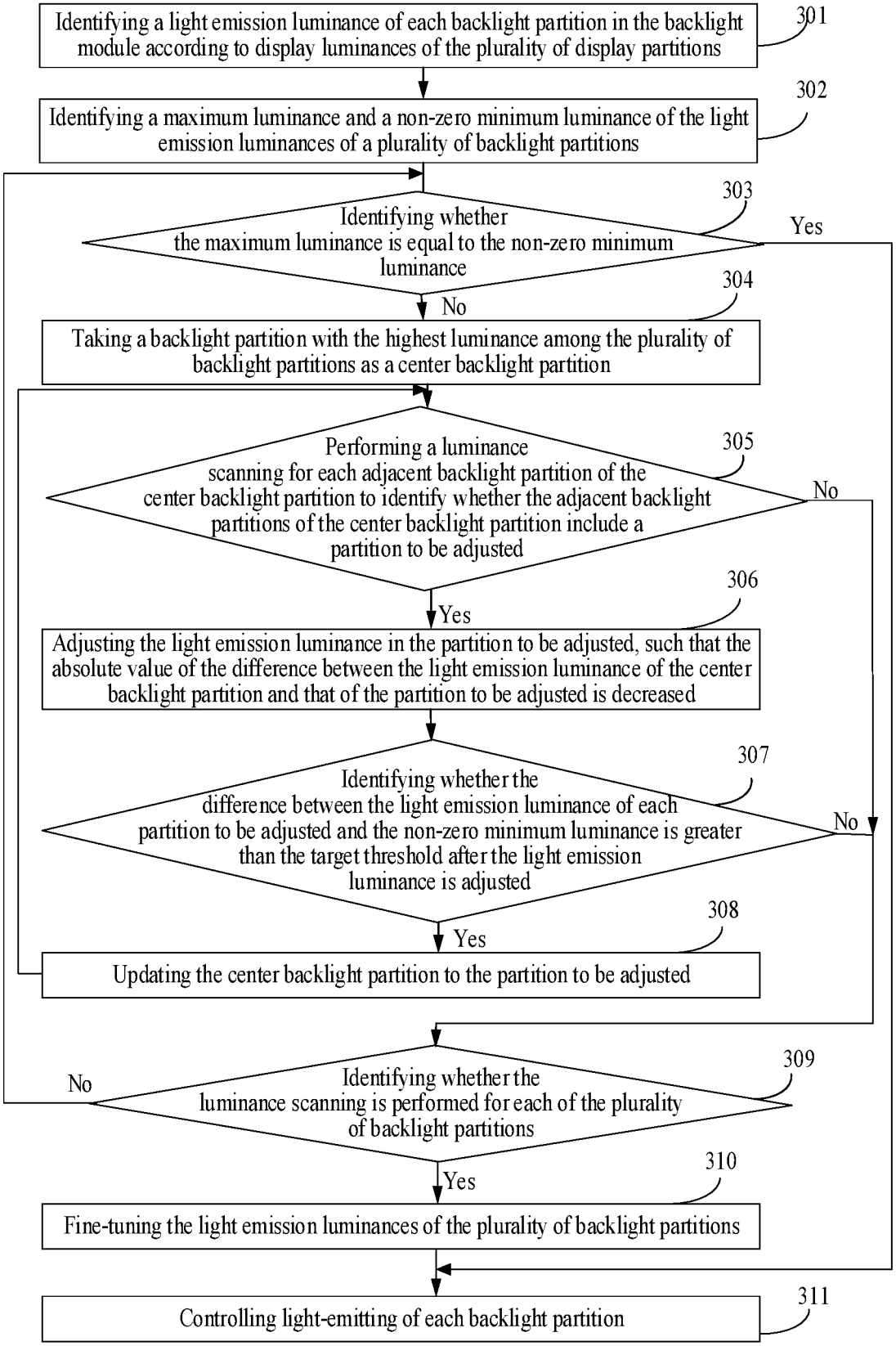
FIG. 3 is a flowchart of another method for controlling a backlight according to an embodiment of the present disclosure.

FIG. 3 is a flowchart of another method for controlling backlight of a display device according to an embodiment of the present disclosure. As illustrated in FIG. 3, the method for controlling the backlight may include the following operations.

In step 301, a light emission luminance of each backlight partition in the backlight module is identified according to display luminances of a plurality of display partitions. Then, step 302 is performed.

Optionally, the display device may include a display panel and a backlight module. A plurality of display partitions in the display panel have a one-to-one correspondence with a plurality of backlight partitions in the backlight module. Each backlight partition is used to provide a backlight for a display partition corresponding to the backlight partition, such that the display partition displays images. The display device may further include a backlight controller, and the method for controlling the backlight according to the present disclosure may be performed by a backlight controller. In step 301, the backlight controller identifies, according to a display luminance of each display partition, a light emission luminance of a backlight partition corresponding to the display partition.

In step 302, a maximum luminance and a non-zero minimum luminance of the light emission luminances of a plurality of backlight partitions are identified. Then, step 303 is performed.

After identifying the light emission luminance of each backlight partition in the backlight module, the backlight controller may also search for the maximum luminance and the non-zero minimum luminance among the identified the light emission luminances of a plurality of backlight partitions.

For example, it is assumed that the backlight module includes 192 backlight partitions, and the 192 backlight partitions include backlight partitions 01 in 8 rows and 24 columns. The light emission luminance of the 192 backlight partitions 01 can be represented by the numerical values in the backlight partitions in FIG. 4, where the numerical value in each backlight partition represents a grayscale of the light emission luminance of the backlight partition. The maximum luminance among the light emission luminances of all backlight partitions is a luminance with 214 grayscales, and the non-zero minimum luminance among the light emission luminances of all the backlight partitions is a luminance with 10 grayscales.

In step 303, whether the maximum luminance is equal to the non-zero minimum luminance is identified. When the maximum luminance is equal to the non-zero minimum luminance, step 311 is performed; or when the maximum luminance is greater than the non-zero minimum luminance, step 304 is performed.

After identifying the maximum luminance and the non-zero minimum luminance, the backlight controller may compare the maximum luminance with the non-zero minimum luminance to identify whether the maximum luminance is equal to the non-zero minimum luminance. When the maximum luminance is equal to the non-zero minimum luminance, the backlight controller may identify that the light emission luminance of all the current backlight partitions are the same and not zero. In this case, step 311 can be directly performed without adjusting the light emission luminance of the backlight partition.

Figure 5:
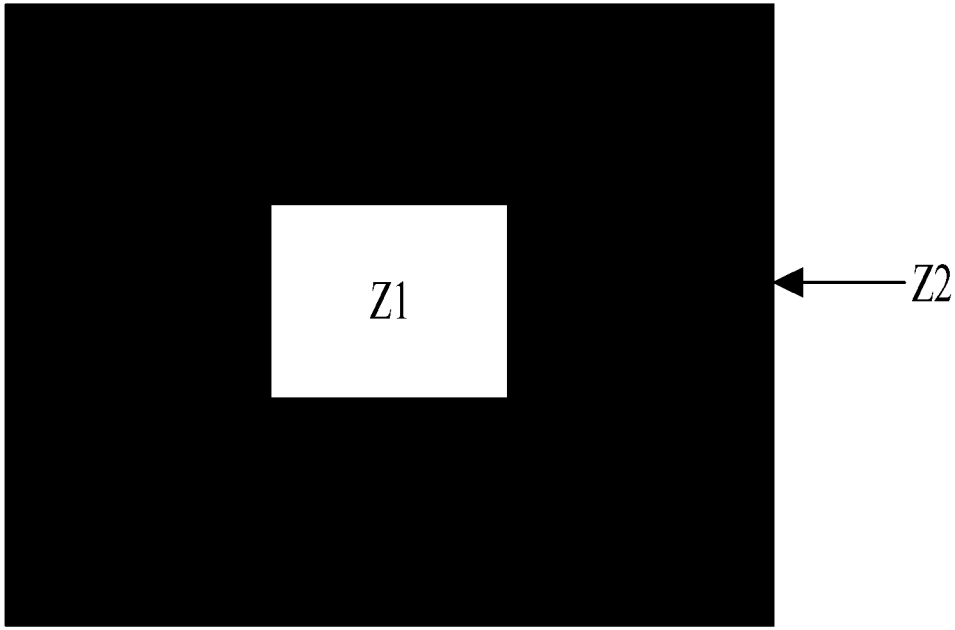
FIG. 5 is a schematic diagram of a display panel during a contrast test according to an embodiment of the present disclosure.

It should be noted that, when testing the contrast of the display panel, as illustrated in FIG. 5, it is necessary to control the center area Z1 of the display panel to emit white light of the same luminance, while a peripheral area Z2 of the display panel does not emit light. In this case, the maximum luminance among the light emission luminances of the backlight partition is the same as the non-zero minimum luminance. Since the halation of the display panel does not affect the contrast of the display panel, there is no need to adjust the light emission luminance of the backlight partition, which simplifies a process of controlling the backlight when testing the contrast of the display panel.

Optionally, the method for controlling the backlight according to the embodiment of the present disclosure may not include step 303, but after step 302, step 304 is directly performed, which is not limited in the embodiment of the present disclosure.

In step 304, a backlight partition with the highest luminance among the plurality of backlight partitions is taken as a center backlight partition. Then, step 305 is performed.

When the maximum luminance is greater than the non-zero minimum luminance, the backlight controller may use the backlight partition with the maximum luminance among the plurality of backlight sections as the center backlight partition. For example, the backlight partition with a luminance of 214 grayscales in FIG. 4 is taken as the center backlight partition.

It should be noted that, there may be one or more backlight partitions with the maximum luminance among the plurality of backlight partitions. In the embodiment of the present disclosure, a plurality of backlight partitions with the maximum luminance are taken as an example.

In step 305, luminance scanning is performed for each adjacent backlight partition of the center backlight partition to identify whether the adjacent backlight partitions of the center backlight partition include a partition to be adjusted. When the adjacent backlight partitions of the center backlight partition include the partition to be adjusted, step 306 is performed; or when the adjacent backlight partition of the center backlight partition do not include the partition to be adjusted, step 309 is performed.

The adjacent backlight partitions of the center backlight partition are: backlight partitions adjacent to the center backlight partition in at least one direction (that is, one or more directions) of the center backlight partition. In the embodiment of the present disclosure, the adjacent backlight partitions of the center backlight partition are: backlight partitions adjacent to the center backlight partition in eight directions of the center backlight partition. That is, the backlight partitions in the eight neighborhoods of the center backlight partition are adjacent backlight partitions of the center backlight partition. For example, as illustrated in FIG. 4, for a backlight partition in the second row and the eleventh column (having a luminance of 214 grayscales) among all the current center backlight partitions, adjacent backlight partitions of the center backlight partition include the following eight backlight partitions: a backlight partition in the second row and the tenth column, a backlight partition in the second row and the twelfth column, a backlight partition in the first row and the tenth column, a backlight partition in the first row and the eleventh column, a backlight partition in the first row and the twelfth column, a backlight partition in the third row and the tenth column, a backlight partition in the third row and the eleventh column, and a backlight partition in the third row and the twelfth column.

It should be noted that, when the center backlight partition is a backlight partition located at the edge among the plurality of backlight partitions, the number of adjacent backlight partitions of the center backlight partition is less than 8. For example, as illustrated in FIG. 4, for the backlight partition in the first row and the twelfth column among the center backlight partitions (having a luminance of 214 grayscales), the adjacent backlight partitions of the center backlight partition includes the following five backlight partitions: a backlight partition in the first row and the eleventh column, a backlight partitions in the first row and the thirteenth column, a backlight partition in the second row and the eleventh column, a backlight partition in the second row and the twelfth column, and a backlight partition in the second row and the thirteenth column.

When performing luminance scanning for each adjacent backlight partition of the center backlight partition, the backlight controller may identify whether an absolute value of a difference between a light emission luminance of the center backlight partition and that of the adjacent backlight partition is greater than a target threshold. When the absolute value of the difference between the light emission luminance of the center backlight partition and that of the adjacent backlight partition is greater than the target threshold, it can be identified that the adjacent backlight partition is a partition to be adjusted. For example, please referring to FIG. 4, for a backlight partition (with a luminance of 214 grayscales) in the second row and the eleventh column among the current center backlight partitions, a light emission luminance of a backlight partition in the second row and the tenth column among the adjacent backlight partitions of the center backlight partition is a luminance of 23 grayscales. When the target threshold is a luminance of 20 grayscales, the backlight controller may identify the backlight partition in the second row and the tenth column as the partition to be adjusted. When the partition to be adjusted and the center backlight partition have a large difference in a light emission luminance, halation in the display panel may be caused.

In step 306, the light emission luminance in the partition to be adjusted is adjusted, such that the absolute value of the difference between the light emission luminance of the center backlight partition and that of the partition to be adjusted is decreased. Then, step 307 is performed.

After identifying the partition to be adjusted in the adjacent backlight partitions of the center backlight partition, the backlight controller may adjust the light emission luminance of the partition to be adjusted to decrease the absolute value of the difference between the light emission luminance of the center backlight partition and that of the partition to be adjusted (for example, making the absolute value of a difference between light emission luminance of the two adjacent backlight partitions be less than or equal to the target threshold, or making the absolute value be decreased and still greater than the target threshold, in the embodiment of the present disclosure, making the absolute value of the difference between the light emission luminance of the two adjacent backlight partitions be less than or equal to the target threshold value for example).

When the difference between the light emission luminance of the center backlight partition and that of the partition to be adjusted is greater than the target threshold, the backlight controller can adjust the light emission luminance of the partition to be adjusted to the difference between the light emission luminance of the center backlight partition and the target threshold. When the difference between the light emission luminance of the center backlight partition and that of the partition to be adjusted is less than or equal to the target threshold, and a difference between a light emission luminance of the partition to be adjusted and that of the center backlight partition is greater than the target threshold, the backlight controller can adjust the light emission luminance of the partition to be adjusted to a sum of the light emission luminance of the center backlight partition and the target threshold.

When adjusting the light emission luminance of the partition to be adjusted, it may not be adjusted according to this adjustment method. For example, a backlight partition with a larger light emission luminance among the center backlight partition and the partition to be adjusted is decreased by a second luminance, where the second luminance is half of the absolute value of the difference between the light emission luminance of the center backlight partition and that of the partition to be adjusted. The embodiment of the present disclosure is not limited to this.

In step 306, when the center backlight partition is the backlight partition with the maximum luminance, the backlight controller only adjusts the light emission luminances of the adjacent backlight partitions of the center backlight partition, but does not adjust the light emission luminance of the center backlight partition. Therefore, it can avoid reducing the maximum luminance of a plurality of backlight partitions during the adjustment process.

In step 307, whether the difference between the light emission luminance of each partition to be adjusted and the non-zero minimum luminance is greater than the target threshold after the light emission luminance is adjusted is identified. When, after the light emission luminance is adjusted, the difference between the light emission luminance of at least one of the partition to be adjusted and the non-zero minimum luminance is greater than the target threshold, step 308 is performed; or when, after the light emission luminance is adjusted, the difference between the light emission luminance of each partition to be adjusted and the non-zero minimum luminance is less than or equal to the target threshold, step 309 is performed.

After adjusting the light emission luminance of all the partitions to be adjusted in the adjacent backlight partitions of the center backlight partition, the backlight controller may compare the current light emission luminance of each partition to be adjusted with the previously identified non-zero minimum luminance to identify whether the difference between the light emission luminance of each partition to be adjusted and the non-zero minimum luminance is greater than the target threshold.

In step 308, the center backlight partition is updated to the partition to be adjusted. Step 305 is performed.

When, after the light emission luminance is adjusted, the difference between the light emission luminance of the at least one of the partitions to be adjusted and the non-zero minimum luminance is greater than the target threshold, the backlight controller needs to update the center backlight partition to all the current partitions to be adjusted, and step 305 is performed based on the updated center backlight partition until, after the light emission luminance is adjusted, the difference between the light emission luminance of each partition to be adjusted and the non-zero minimum luminance is less than or equal to the target threshold. It can be seen that, in the embodiment of the present disclosure, the backlight partition with the maximum luminance is initially used as the center backlight partition, and the center backlight partition is gradually diffused outward in the subsequent process to perform luminance scanning and adjustment of light emission luminance on a plurality of backlight partitions. Specifically, steps 305 to 307 are an adjustment process, and for each center backlight partition, the adjustment processes in steps 305 to 307 need to be performed.

In step 309, whether the luminance scanning is performed for each of the plurality of backlight partitions is identified. When the luminance scanning is not performed for at least one of the plurality of backlight partitions, step 303 is performed. When the luminance scanning is performed for the plurality of backlight partitions, step 310 is performed.

In step 309, the backlight controller needs to detect whether the luminance scanning in step 305 is performed for each backlight partition. When the luminance scanning is not performed for at least one backlight partition, the backlight controller needs to repeat step 303 to step 308 for all the current backlight partitions until the luminance scanning is performed for all the backlight partitions, such that no such two adjacent backlight partitions are present with an absolute value of the difference between light emission luminance of the two adjacent backlight partitions being greater than the target threshold.

Figure 6:
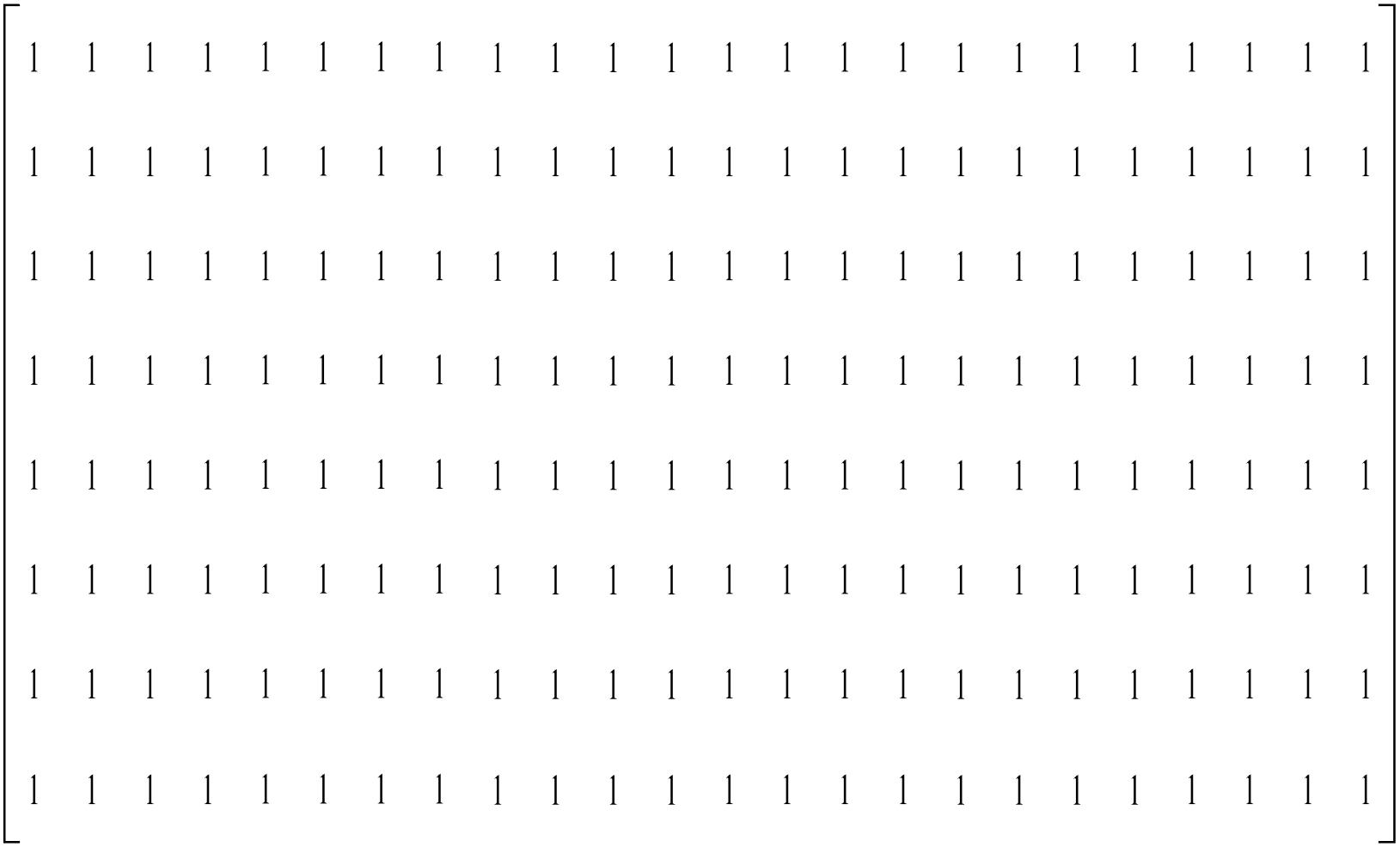
FIG. 6 is a schematic diagram of a flag matrix according to an embodiment of the present disclosure.
Figure 7:
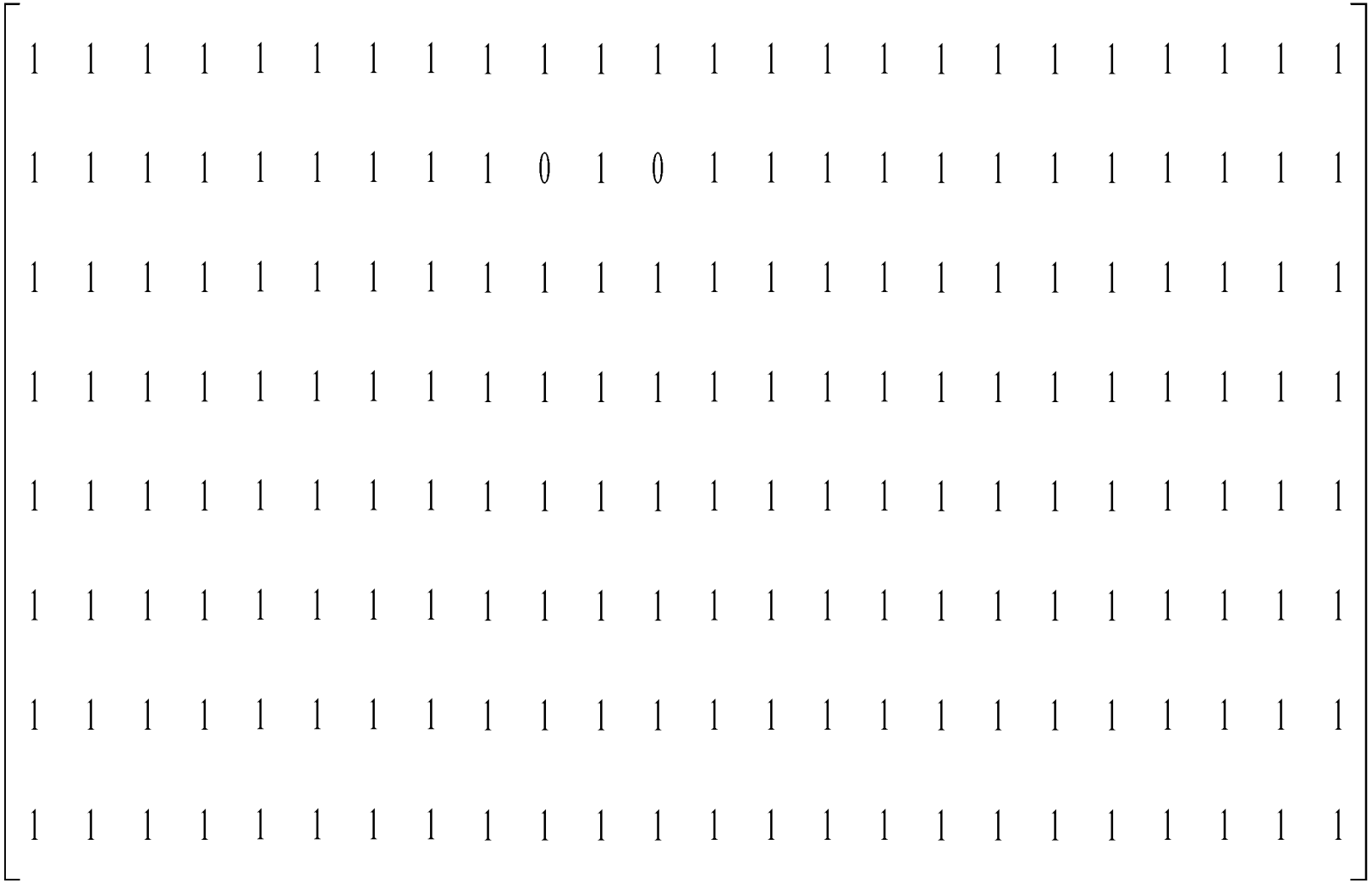
FIG. 7 is a schematic diagram of another flag matrix according to an embodiment of the present disclosure.

Optionally, the plurality of backlight partitions may include backlight partitions in m rows and n columns, $m \geq 1$, $n \geq 1$. Before performing luminance scanning for the backlight partitions, the backlight controller may further obtain a flag matrix in m rows and n columns, and each element of the flag matrix is not zero. Optionally, each element of the flag matrix may be the same or different, and each element of the flag matrix may be 1, or may not be 1 (a number such as 2, 3, or −1, or the like), which is not limited in the embodiments of the present disclosure. For example, the flag matrix may be as illustrated in FIG. 6, each element of the flag matrix is equal to 1, and m=8 and n=24 are taken as an example in FIG. 6. When performing luminance scanning for the backlight partition in an row and a $j^{th}$ column, the backlight controller may assign a value of 0 to the element in the $i^{th}$ row and the $j^{th}$ column of the flag matrix, $1 \leq i \leq m$, $1 \leq j \leq n$. For example, when performing luminance scanning for the backlight partition in the second row and the tenth column, a value of 0 is assigned to the element in the second row and the tenth column of the flag matrix as illustrated in FIG. 6. When performing luminance scanning for the backlight partition in the second row and the twelfth column, a value of 0 is assigned to the element in the second row and the twelfth column of the flag matrix, such that the flag matrix as illustrated in FIG. 7 is obtained.

When it is identified whether the luminance scanning is performed for each of the plurality of backlight partitions, the backlight controller can identify whether there is a non-zero element in the flag matrix. When there is a non-zero element in the flag matrix, the backlight controller can identify that the luminance scanning is not performed for at least one of the plurality of backlight partitions. When the elements in the flag matrix are zero, the backlight controller can identify that the luminance scanning is performed for the plurality of backlight partitions.

Further, each element of the flag matrix obtained before performing the luminance scanning for the backlight partition is 1. When the backlight controller identifies whether there is any non-zero element in the flag matrix, whether the sum of all elements of the flag matrix is zero may be identified. When the sum of all elements is zero, the backlight controller may identify that the elements of the flag matrix are all zero; or when the sum of all elements is greater than zero, the backlight controller may identify that there is a non-zero element in the flag matrix.

Optionally, the method for controlling a backlight according to the embodiment of the present disclosure may not include step 309, which is not limited in the embodiment of the present disclosure. In this case, when the identification results in step 305 and step 307 are negative, step 310 may be directly performed.

In step 310, the light emission luminances of the plurality of backlight partitions are fine-tuned. Then, step 311 is performed.

When the light emission luminance a plurality of backlight partitions are fine-tuned, the adjacent backlight partitions of each of the plurality of backlight partitions can be sequentially fine-tuned by the backlight controller.

Specifically, when the adjacent backlight partitions of a $p_{th}$ backlight partition are fine-tuned, whether a light emission luminance of a $k^{th}$ adjacent backlight partition of the $p^{th}$ backlight partition is greater than a light emission luminance of the $p^{th}$ backlight partition may be identified when the light emission luminances of the plurality of backlight partitions are not adjusted. When the light emission luminance of the $k^{th}$ adjacent backlight partition is greater than the light emission luminance of the $p^{th}$ backlight partition, the light emission luminance of the $k^{th}$ adjacent backlight partition is increased by a first luminance; or when the light emission luminance of the $k^{th}$ adjacent backlight partition is less than or equal to the light emission luminance of the $p^{th}$ backlight partition, the light emission luminance of the $k^{th}$ adjacent backlight partition is decreased by the first luminance, Specifically, $p \geq 1$, $k \geq 1$; the first luminance $$\Delta Lk = \frac{(Lk - Lp) * Q2}{Lx - Ly},$$

Lk represents the light emission luminance of the $k^{th}$ adjacent backlight partition when the light emission luminances of the plurality of backlight partitions are not adjusted, Lp represents the light emission luminance of the $p^{th}$ backlight partition when the light emission luminances of the plurality of backlight partitions are not adjusted, Q2 represents an auxiliary threshold, Lx represents the maximum luminance (a maximum luminance among the light emission luminances of a plurality of backlight partitions when the light emission luminances of the plurality of backlight partitions are not adjusted), and Ly represents the non-zero minimum luminance (a non-zero minimum luminance among the light emission luminances of a plurality of backlight partitions when the light emission luminances of the plurality of backlight partitions are not adjusted).

After the adjacent backlight partitions of the $p^{th}$ backlight partition are fine-tuned, the adjacent backlight partitions of the $(p+1)^{th}$ backlight partition can be fine-tuned until adjacent backlight partitions of all the backlight partitions are fine-tuned. In step 310, based on the relationship between the size of the light emission luminance of the backlight partitions before the adjustment, the light emission luminance of the backlight partitions is further adjusted to ensure that the relationship between the size of the light emission luminances of the backlight partitions before and after the adjustment of the light emission luminance remains unchanged, such that the difference between the light emission luminances before and after adjusting the backlight partition is small, and also making the backlight partition with the maximum luminance unchanged before and after adjusting the light emission luminance.

Optionally, the sum of the target threshold and the auxiliary threshold may be less than or equal to the luminance of 40 grayscales, for example, the target threshold and the auxiliary threshold are both the luminance of 20 grayscales, or one of the target threshold and the auxiliary threshold is the luminance of 30 grayscales, the other is the luminance of 10 grayscales. The sum of the target threshold and the auxiliary threshold can also be adjusted, for example, the sum of the target threshold and the auxiliary threshold can also be less than or equal to other luminance (such as luminance of 50 grayscales, etc.), which is not limited in the embodiments of the present disclosure. For example, when the sum of the target threshold and the auxiliary threshold can be less than or equal to the luminance of 40 grayscales, the backlight module where the plurality of backlight sections are located may be applicable for a 15.6-inch display panel. After the light emission luminance of the backlight partition is adjusted by using the method for controlling the backlight according to the embodiment of the present disclosure, an absolute value of a difference between light emission luminance of any two adjacent backlight partitions can be less than or equal to the sum of the target threshold and the auxiliary threshold.

It should be noted that in the embodiment of the present disclosure, the adjustment process of the light emission luminance of the backlight partition includes two parts as an example. These two parts are the first part of the adjustment in steps 303 to 309, and the second part of the adjustment in step 310. Optionally, the second part of the adjustment may not be performed (that is, step 310 is not performed), but step 311 is directly performed after step 309, which is not limited in the embodiment of the present disclosure.

In step 311, light-emitting of each backlight partition is controlled.

When it is identified that the light emission luminances in a plurality of backlight partitions do not need to be adjusted (for example, it has never been adjusted and no adjustment is needed, or the adjusted light emission luminance does not need to be adjusted again), each backlight partition can be controlled to emit light of its light emission luminance.

The following will take the processing of the light emission luminances of the plurality of backlight partitions illustrated in FIG. 4 as an example to compare the difference between the light emission luminances before and after the adjustment.

For example, it can be seen from the light emission luminances of the plurality of backlight partitions illustrated in FIG. 4, a plurality of adjacent backlight partitions are present with the absolute value of the difference between light emission luminances of the plurality of adjacent backlight partitions being greater than the target threshold (the target threshold is the luminance of 20 grayscales as an example in the embodiment of the present disclosure). After the light emission luminance of the backlight partition illustrated in FIG. 4 is processed by using the method for controlling the backlight illustrated in FIG. 3, the light emission luminances of the plurality of backlight partitions illustrated in FIG. 8 can be obtained. It can be seen from FIG. 8, the absolute value of the difference between light emission luminances of any two adjacent backlight partitions in FIG. 8 is less than the absolute value of the difference between the light emission luminances of the two adjacent backlight partitions in FIG. 4. For example, for the backlight partition in the first row and the eleventh column and the backlight partition in the first row and the twelfth column, the absolute value of the difference between the light emission luminances of the two backlight partitions in FIG. 4 is the luminance of 189 grayscales. The absolute value of the difference between the light emission luminances of the two backlight partitions in FIG. 8 is the luminance of 24 grayscales. It can be seen that, after the adjustment of the light emission luminance, the absolute value of the difference between the light emission luminances of the adjacent backlight partitions are greatly decreased. In addition, before and after the light emission luminance is adjusted, the light emission luminance of the backlight partition in the first row and the eleventh column is less than the light emission luminance of the backlight partition in the first row and the twelfth column, that is, the relationship of the size between the backlight partitions has not changed. In addition, before and after the light emission luminance is adjusted, the backlight partitions with the highest luminance among the plurality of backlight partitions are the same.

In the following, the adjustment of the light emission luminances of the plurality of backlight partitions illustrated in FIG. 9 is taken as an example to compare the difference between the light emission luminances before and after the adjustment.

It should be noted that, FIG. 9 illustrates the light emission luminances of a plurality of backlight partitions when performing a contrast test for the display panel. It can be seen that, the light emission luminances of the backlight partitions in the center area in the plurality of backlight partitions are all luminances of 255 grayscales; and the light emission luminances of the backlight partitions in the peripheral area in the plurality of backlight partitions are all the luminances of 0 grayscale. After the light emission luminance of the backlight partition illustrated in FIG. 9 is processed by using the method for controlling the backlight illustrated in FIG. 3, the obtained light emission luminances the plurality of backlight partitions are the same as the light emission luminance illustrated in FIG. 9. Specifically, after performing step 303, the backlight controller may identify that the maximum luminance and the minimum non-zero luminance in FIG. 9 are both the luminances of 255 grayscales, that is, the maximum luminance in FIG. 9 is equal to the minimum non-zero luminance. Therefore, step 311 can be directly performed, that is, each backlight partition is directly controlled to emit light of its luminance rather than the light emission luminance of the backlight partition is not adjusted. In addition, since the light emission luminance of the backlight partition is not adjusted, it is ensured that the maximum and minimum light emission luminances of the backlight partition before and after processing remain unchanged, which facilitates the detection of contrast.

Optionally, the backlight partitions in a backlight module is arranged in array, for example, the backlight module includes backlight partitions in m rows and n columns. Therefore, the backlight controller can record the light emission luminance of the backlight partition through the m rows and n columns matrix. The element in the $i^{th}$ row and $j^{th}$ column of the matrix is the light emission luminance of the backlight partition in the $i^{th}$ row and $j^{th}$ column, $m \geq i > 0$, $n \div j > 0$. The backlight controller can adjust the light emission luminance of the backlight partition based on the matrix, where adjusting the light emission luminance of the backlight partition in the $i^{th}$ row and $j^{th}$ column is equivalent to adjusting the element of the $i^{th}$ and $j^{th}$ column in the matrix. In step 311, the backlight controller can control the backlight partition in the $i^{th}$ row and the $j^{th}$ column to emit light having the same luminance as the value of the element based on the element of the $i^{th}$ row and the $j^{th}$ column in the matrix.

In summary, in the method for controlling the backlight according to the embodiment of the present disclosure, by adjusting the light emission luminance of at least one backlight partition, the difference between the light emission luminance of the at least one backlight partition and that of the adjacent backlight partition is minimized. In addition, the smaller the difference between the light emission luminance of the backlight partition and that of the adjacent backlight partition is, the less obvious the halation in the display device is. Therefore, by decreasing the difference between the light emission luminances in the present disclosure, the halation in the display panel may be reduced, and thus the display effect of the display panel may be improved.

Figure 10:
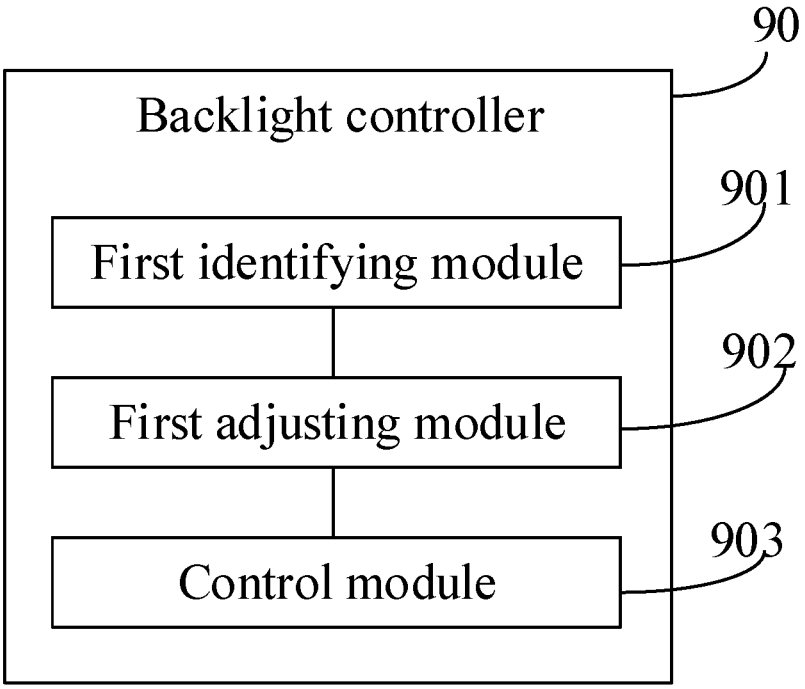
FIG. 10 is a schematic structural diagram of a backlight controller according to an embodiment of the present disclosure.

FIG. 10 is a schematic structural diagram of a backlight controller of a display device according to an embodiment of the present disclosure. As illustrated in FIG. 10, the backlight controller 90 may include:

a first identifying module 901, configured to identify a light emission luminance of each backlight partition in a backlight module according to display luminances of a plurality of display partitions;

a first adjusting module 903, configured to, when the plurality of backlight partitions include two adjacent backlight partitions, and an absolute value of a difference between the light emission luminances of the two adjacent backlight partitions is greater than a target threshold, adjust the light emission luminance of at least one of the two adjacent backlight partitions to decrease the absolute value of the difference between the light emission luminances of the two adjacent backlight partitions; and a control module 903, configured to control, after the light emission luminance is adjusted, light-emitting of each of the backlight partitions.

In summary, in the backlight controller of the display device according to the embodiment of the present disclosure, the light emission luminance of at least one of the two adjacent backlight partitions is adjusted by the first adjustment module such that the difference between the light emission luminance of the at least one backlight partition and that of the adjacent backlight partition is minimized. In addition, the smaller the difference between the light emission luminance of the backlight partition and that of the adjacent backlight partition is, the less obvious the halation in the display device is. Therefore, by decreasing the difference between the light emission luminances in the present disclosure, the halation in the display panel may be reduced, and thus the display effect of the display panel may be improved.

Optionally, the first adjusting module 902 may be configured to adjust the light emission luminance of the at least one of the two adjacent backlight partitions to make the absolute value of the difference between the light emission luminances of the two adjacent backlight partitions be less than or equal to the target threshold.

Optionally, the first adjusting module 902 may be configured to:

by taking a backlight partition with the highest luminance in the plurality of backlight partitions as a center backlight partition, perform an adjustment process. The adjustment process includes: when the adjacent backlight partitions of the center backlight partition include a partition to be adjusted, and an absolute value of a difference between the light emission luminance of the center backlight partition and that of the partition to be adjusted is greater than the target threshold, adjusting the light emission luminance of the partition to be adjusted, to decrease the absolute value of the difference between the light emission luminance of the center backlight partition and that of the partition to be adjusted; and when, after the light emission luminance is adjusted, the difference between the light emission luminance of at least one of the partition to be adjusted and a non-zero minimum luminance is greater than the target threshold, updating the center backlight partition to the partition to be adjusted, and repeating the adjustment process until the difference between the light emission luminance of each partition of the partition to be adjusted, after the light emission luminance is adjusted, and the non-zero minimum luminance is less than or equal to the target threshold. The non-zero minimum luminance is: a non-zero minimum luminance of the light emission luminances of the plurality of backlight partitions before the light emission luminance of the at least one of the two adjacent backlight partitions is adjusted.

Optionally, adjusting the light emission luminance of the partition to be adjusted may include: when the difference between the luminance of the center backlight partition and that of the partition to be adjusted is greater than the target threshold, adjusting the luminance of the partition to be adjusted to a difference between the light emission luminance of the center backlight partition and the threshold value; and when the difference between the light emission luminance of the center backlight partition and that of the partition to be adjusted is less than or equal to the target threshold, and the difference between the light emission luminance of the partition to be adjusted and that of the center backlight partition is greater than the threshold value, adjusting the light emission luminance of the partition to be adjusted to a sum of the light emission luminance of the center backlight partition and the threshold value.

Optionally, the adjustment process may further include: performing luminance scanning for each of the adjacent backlight partitions of the center backlight partition to identify whether each of the adjacent backlight partitions of the center backlight partition is the partition to be adjusted.

Figure 11:
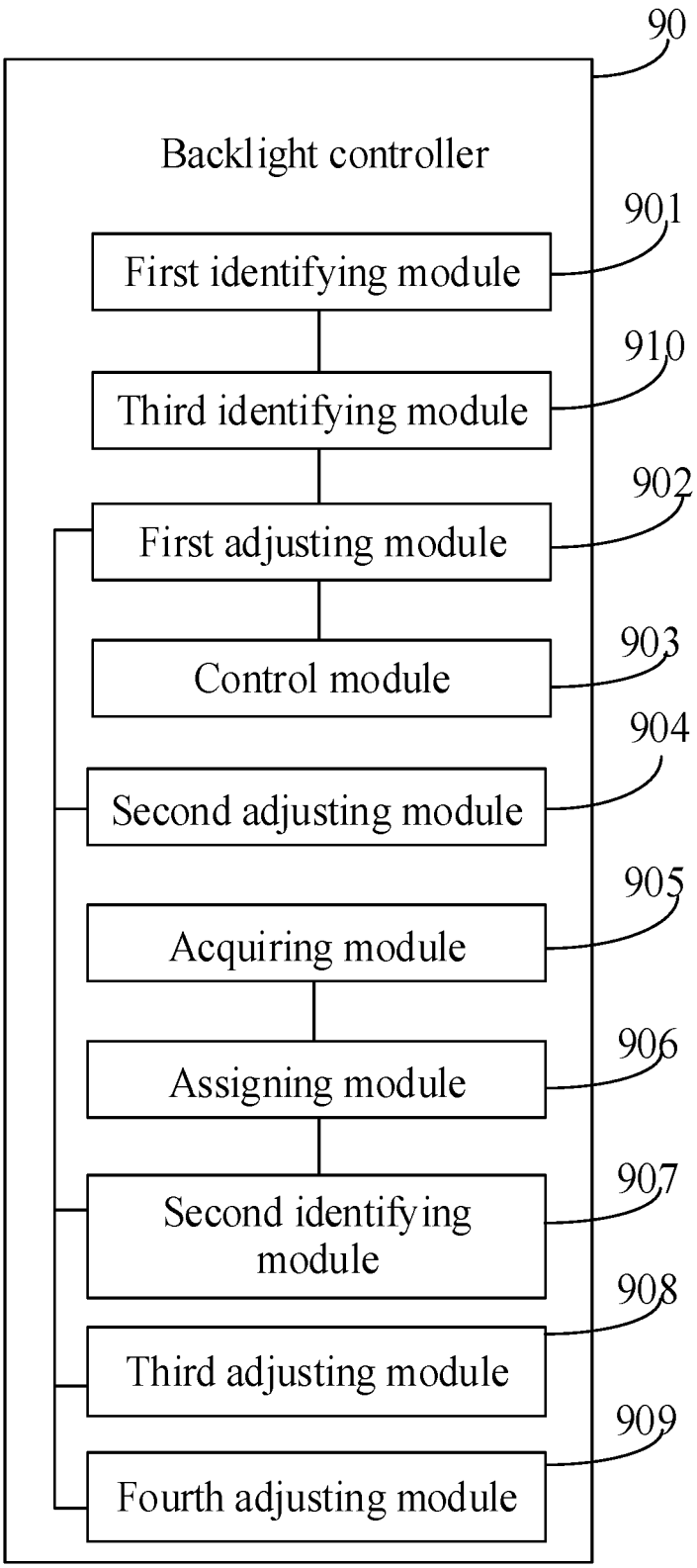
FIG. 11 is a schematic structural diagram of another backlight controller according to an embodiment of the present disclosure.

FIG. 11 is a schematic structural diagram of another backlight controller according to an embodiment of the present disclosure. As illustrated in FIG. 11, based on FIG. 10, the backlight controller may further include:

a second adjusting module 904, configured to, when the luminance scanning is not performed for at least one of the plurality of backlight partitions, if the plurality of backlight partitions include two adjacent backlight partitions, and an absolute value of the difference between the light emission luminances of the two adjacent backlight partitions is greater than the target threshold, adjust the light emission luminance of the at least one of the two adjacent backlight partitions to decrease the absolute value of the difference between the light emission luminances of the two adjacent backlight partitions.

Optionally, the plurality of backlight partitions include backlight partitions in m rows and n columns, m≥1, n≥1, and the backlight controller further includes:

an acquiring module 905, configured to acquire a flag matrix in m rows and n columns, where each element of the flag matrix is not zero;

an assigning module 906, configured to, when performing luminance scanning for the backlight partition in the $i^{th}$ row and the $j^{th}$ column, assign a value of 0 to the element in the $i^{th}$ row and the $j^{th}$ column of the flag matrix, $1 \le i \le m$, $1 \le j \le n$; and a second identifying module 907, configured to, when there is a non-zero element in the flag matrix, identify that the luminance scanning is not performed for at least one of the plurality of backlight partitions.

Optionally, the backlight controller may further include:

a third adjustment module 908, configured to, when the luminance scanning is performed for all the backlight partitions, if the light emission luminances of the plurality of backlight partitions are not adjusted, and the light emission luminance of the $k^{th}$ adjacent backlight partition of the $p^{th}$ backlight partition is greater than the light emission luminance of the $p^{th}$ backlight partition, increase the light emission luminance of the $k^{th}$ adjacent backlight partition by a first luminance, p≥1, k≥1, and a fourth adjustment module 909, configured to, when the luminance scanning is performed for all the backlight partitions, if the light emission luminances of the plurality of backlight partitions are not adjusted, and the light emission luminance of the $k^{th}$ adjacent backlight partition is less than or equal to the light emission luminance of the $p^{th}$ backlight partition, decrease the light emission luminance of the $k^{th}$ adjacent backlight partition by a first luminance;

where the first luminance is $$\Delta Lk = \frac{(Lk - Lp) * Q2}{Lx - Ly},$$

Lk represents the light emission luminance of the $k^{th}$ adjacent backlight partition when the light emission luminances of the plurality of backlight partitions are not adjusted, Lp represents the light emission luminance of the $p^{th}$ backlight partition when the light emission luminances of the plurality of backlight partitions are not adjusted, Q2 represents an auxiliary threshold, Lx represents the maximum luminance, and Ly represents the non-zero minimum luminance.

Optionally, the backlight controller 90 may further include:

a third identifying module 910, configured to, before adjusting the light emission luminance of at least one of the two adjacent backlight partitions, identify a maximum luminance and a non-zero minimum luminance of the light emission luminances of the plurality of backlight partitions; and a first adjusting module 902, configured to, when the maximum luminance is not equal to the non-zero minimum luminance, and the plurality of backlight partitions include two adjacent backlight partitions, and an absolute value of a difference between the light emission luminances of the two adjacent backlight partitions is greater than a target threshold, adjust the light emission luminance of the at least one of the two adjacent backlight partitions.

Optionally, the adjacent backlight partitions of the center backlight partition may be: backlight partitions adjacent to the center backlight partition in eight directions of the center backlight partition.

Optionally, a sum of the target threshold and the auxiliary threshold may be less than or equal to a luminance of 40 grayscales.

Optionally, each element of the flag matrix may be equal to 1.

In summary, in the backlight controller of the display device according to the embodiment of the present disclosure, the light emission luminance of at least one of the two adjacent backlight partitions is adjusted by the first adjusting module such that the difference between the light emission luminance of the at least one backlight partition and that of the adjacent backlight partition is minimized. In addition, the smaller the difference between the light emission luminance of the backlight partition and that of the adjacent backlight partition is, the less obvious the halation in the display device is. Therefore, by decreasing the difference between the light emission luminances in the present disclosure, the halation in the display panel may be reduced, and thus the display effect of the display panel may be improved.

An embodiment of the present disclosure further provides a storage medium. The storage medium stores thereon at least one computer instruction executable by a processor, wherein the at least one computer instruction, when executed by the processor, enables the processor to perform the method for controlling the backlight according to the embodiment of the present disclosure (for example, the method for controlling the backlight of a display device as illustrated FIG. 2 or FIG. 3).

Figure 12:
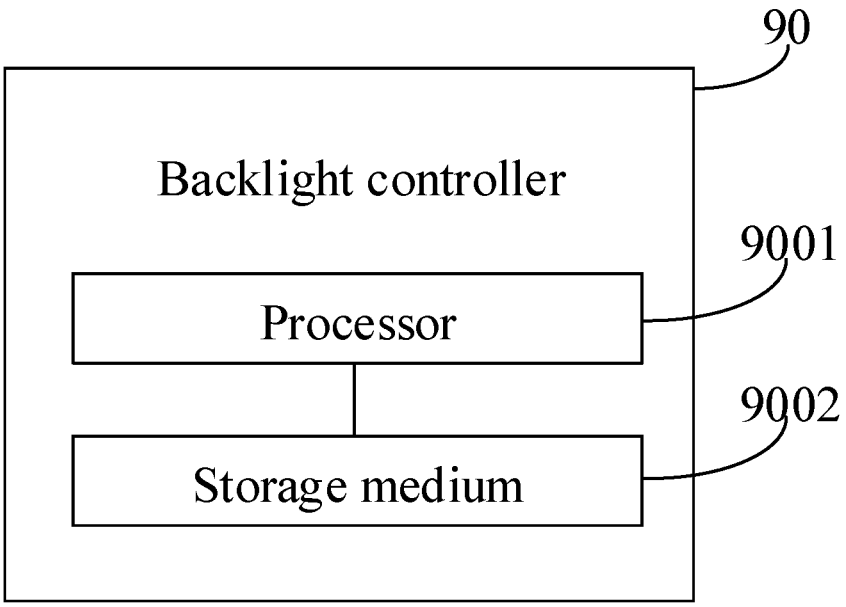
FIG. 12 is a schematic structural diagram of another backlight controller according to an embodiment of the present disclosure.

FIG. 12 is a schematic structural diagram of another backlight controller according to an embodiment of the present disclosure. As illustrated in FIG. 12, the backlight controller 90 may include: a processor 9001 and a storage medium. Specifically, the storage medium 9002 is configured to store at least one computer instruction executable by the processor 9001, and the at least one computer instruction, when executed by the processor, enables the processor to perform the method for controlling the backlight of the display device according to the embodiment of the present disclosure (for example, the method for controlling the backlight of a display device as illustrated FIG. 2 or FIG. 3).

Figure 13:
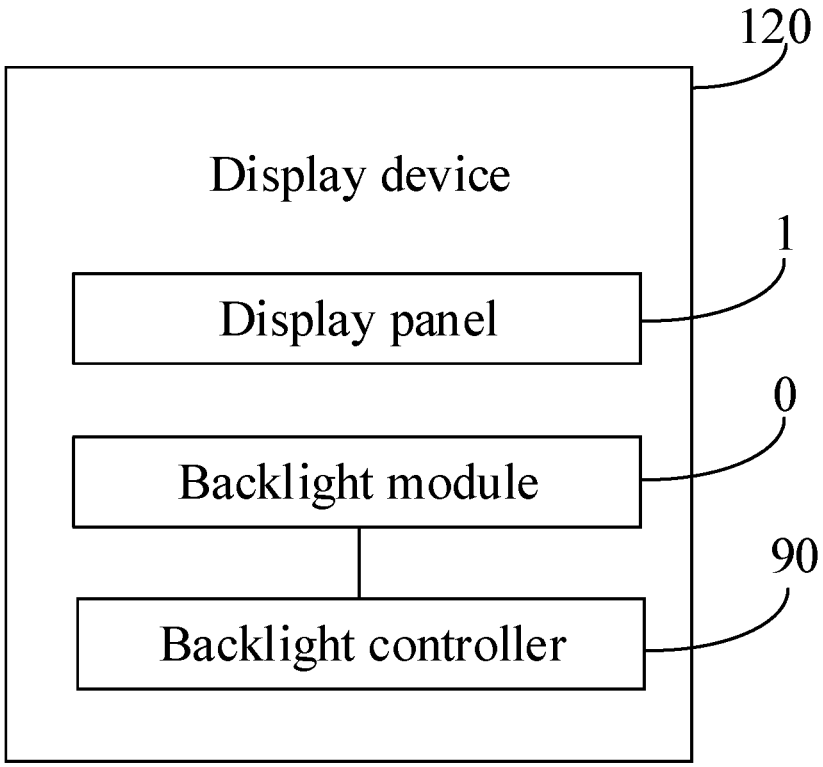
FIG. 13 is a schematic structural diagram of a display device according to an embodiment of the present disclosure.

FIG. 13 is a schematic structural diagram of a display device according to an embodiment of the present disclosure. A display device 120 includes: a display panel 1, a backlight module 0 and a backlight controller 90. Specifically, the backlight module 0 is located on a light incident side of the display panel 1, and the backlight controller 90 is electrically connected to the backlight module 0. The backlight controller 90 is the backlight controller 90 illustrated in FIG. 9 or FIG. 10, or the backlight controller 90 is the backlight controller 90 illustrated in FIG. 12. The display device according to the embodiment of the present disclosure may be a liquid crystal display device, and accordingly, the display panel in the display device may be a liquid crystal display panel.

It should be noted that, the method embodiments according to the embodiments of the present disclosure can be cross-referenced with the embodiments of the corresponding backlight controller, which are not limited in the embodiments of the present disclosure. An order of the steps of the method provided in the embodiments of the present disclosure may be properly adjusted, and the steps may also be increased or decreased according to the actual needs. Methods to which mortifications readily figured out by those skilled in the art within the technical scope disclosed by the present disclosure shall fall within the protection scope of the present disclosure. Therefore, details are not described herein.

Described above are merely optional embodiments of the present disclosure, and are not intended to limit the present disclosure. Within the spirit and principles of the disclosure, any modifications, equivalent substitutions, improvements, or the like are within the protection scope of the present disclosure.

What is claimed is:

1. A method for controlling backlight of a display device, the display device comprising: a display panel and a backlight module, wherein the display, panel comprises a plurality of display partitions, and the backlight module comprises a plurality of backlight partitions one-to-one corresponding to the plurality of display partitions, the method comprising:

identifying a light emission luminance of each backlight partition in the backlight module according to display luminances of the plurality of display partitions;

by taking a backlight partition with the highest luminance in the plurality of backlight partitions as a center backlight partition, performing an adjustment process, wherein the adjustment process comprises:

when the adjacent backlight partitions of the center backlight partition comprise a partition to be adjusted and an absolute value of a difference between the light emission luminance of the center backlight partition and that of the partition to be adjusted is greater than the target threshold, adjusting the light emission luminance of the partition to be adjusted, to decrease the absolute value of the difference between the light emission luminance of the center backlight partition and that of the partition to be adjusted; wherein when the difference between the luminance of the center backlight partition and that of the partition to be adjusted is greater than the target threshold, adjusting the luminance of the partition to be adjusted to a difference between the light emission luminance of the center backlight partition and the threshold value; and when the difference between the light emission luminance of the center backlight partition and that of the partition to be adjusted is less than or equal to the target threshold, and the difference between the light emission luminance of the partition to be adjusted and that of the center backlight partition is greater than the threshold value, adjusting the light emission luminance of the partition to be adjusted to a sum of the light emission luminance of the center backlight partition and the threshold value;

when, after the light emission luminance is adjusted, the difference between the light emission luminance of at least one of the partition to be adjusted and a non-zero minimum luminance is greater than the target threshold, updating the center backlight partition to the partition to be adjusted, and repeating the adjustment process until the difference between the light emission luminance of each partition of the partition to be adjusted, after the light emission luminance is adjusted, and the non-zero minimum luminance is less than or equal to the target threshold, wherein the non-zero minimum luminance is: a non-zero minimum luminance of the light emission luminances of the plurality of backlight partitions before the light emission luminance of the at least one of the two adjacent backlight partitions is adjusted; and controlling light-emitting of each of the backlight partitions after the adjusting of the light emission luminance is completed.

2. The method according to claim 1 wherein the adjusting the light emission luminance of the partition to be adjusted, to decrease the absolute value of the difference between the light emission luminance of the center backlight partition and that of the partition to be adjusted, comprises:

adjusting the light emission luminance of the partitions to be adjusted to make the absolute value of the difference between the light emission luminance of the center backlight partition and that of the partition to be adjusted be less than or equal to the target threshold.

3. The method according to claim 2, wherein the method further comprises:

identifying a max luminance and a non-zero minimum luminance of the light emission luminances of the plurality of backlight partitions;

when the maximum luminance is not equal to the non-zero minimum luminance, and the plurality of backlight partitions comprise two adjacent backlight partitions, and an absolute value of a difference between the light emission luminances of the two adjacent backlight partitions is greater than a target threshold, adjusting the light emission luminance of the at least one of the two adjacent backlight partitions.

4. The method according to claim 1, wherein the adjustment process further comprises: performing luminance scanning for each of the adjacent backlight partitions of the center backlight partition to identify whether each of the adjacent backlight partitions of the center backlight partition is the partition to be adjusted;

after adjusting the light emission luminance of the at least one of the two adjacent backlight partitions, the method further comprises:

when the luminance scanning is not performed for at least one of the plurality of backlight partitions, if the plurality of backlight partitions comprise the two adjacent backlight partitions, and the absolute value of the difference between the light emission luminances of the two adjacent backlight partitions is greater than the target threshold, adjusting the light emission luminance of the at least one of the two adjacent backlight partitions to decrease the absolute value of the difference between the light emission luminances of the two adjacent backlight partitions.

5. The method according to claim 4, wherein the plurality of backlight partitions comprise backlight partitions in m rows and n columns, m≥1, n≥1, and the method further comprises:

acquiring a flag matrix in m rows and n columns, wherein each element of the flag matrix is not zero;

when performing luminance scanning for the backlight partition in an ith row and a jth column, assigning the element in the ith row and the jth column of the flag matrix to a value of 0, 1≥i≥m, 1≥j≥n; and when there is a non-zero element in the flag matrix, identifying that the luminance scanning is not performed for at least one of the plurality of backlight partitions.

6. The method according to claim 5, wherein each element of the flag matrix is equal to 1.

7. The method according to claim 5, wherein the method further comprises:

when the luminance scanning is performed for all the backlight partitions, if the light emission luminances of the plurality of backlight partitions are not adjusted, and the light emission luminance of a kth adjacent backlight partition of a pth backlight partition is greater than the light emission luminance of the pth backlight partition, increasing the light emission luminance of the kth adjacent backlight partition by a first luminance, p≥1, k≥1; and when the luminance scanning is performed for all the backlight partitions, if the light emission luminances of the plurality of backlight partitions are not adjusted, and the light emission luminance of the kth adjacent backlight partition is less than or equal to the light emission luminance of the pth backlight partition, decreasing the light emission luminance of the kth adjacent backlight partition by a first luminance;

wherein the first luminance $$\Delta Lk = \frac{(Lk - Lp) * Q2}{Lx - Ly},$$

Lk represents the light emission luminance of the kth adjacent backlight partition when the light emission luminances of the plurality of backlight partitions are not adjusted, Lp represents the light emission luminance of the pth backlight partition when the light emission luminances of the plurality of backlight partitions are not adjusted, Q2 represents an auxiliary threshold, Lx represents the maximum luminance, and Ly represents the non-zero minimum luminance.

8. The method according to claim 4, wherein the method further comprises:

when the luminance scanning is performed for all the backlight partitions, if the light emission luminances of the plurality of backlight partitions are not adjusted, and the light emission luminance of a kth adjacent backlight partition of a pth backlight partition is greater than the light emission luminance of the pth backlight partition, increasing the light emission luminance of the kth adjacent backlight partition by a first luminance, p≥1, k≥1, and when the luminance scanning is performed for all the backlight partitions, if the light emission luminances of the plurality of backlight partitions are not adjusted, and the light emission luminance of the kth adjacent backlight partition is less than or equal to the light emission luminance of the pth backlight partition, decreasing the light emission luminance of the kth adjacent backlight partition by a first luminance;

wherein the first luminance $$\Delta Lk = \frac{(Lk - Lp) * Q2}{Lx - Ly},$$

Lk represents the light emission luminance of the kth adjacent backlight partition when the light emission luminances of the plurality of backlight partitions are not adjusted, Lp represents the light emission luminance of the pth backlight partition when the light emission luminances of the plurality of backlight partitions are not adjusted, Q2 represents an auxiliary threshold, Lx represents the maximum luminance, and Ly represents the non-zero minimum luminance.

9. The method according to claim 8, wherein a sum of the target threshold and the auxiliary threshold is less than or equal to a luminance of 40 grayscales.

10. The method according to claim 4, wherein the method further comprises:

identifying a max luminance and a non-zero minimum luminance of the light emission luminances of the plurality of backlight partitions;

when the maximum luminance is not equal to the non-zero minimum luminance, and the plurality of backlight partitions comprise two adjacent backlight partitions, and an absolute value of a difference between the light emission luminances of the two adjacent backlight partitions is greater than a target threshold, adjusting the light emission luminance of the at least one of the two adjacent backlight partitions.

11. The method according to claim 1, wherein the method further comprises:

identifying a max luminance and a non-zero minimum luminance of the light emission luminances of the plurality of backlight partitions;

when the maximum luminance is not equal to the non-zero minimum luminance, and the plurality of backlight partitions comprise two adjacent backlight partitions, and an absolute value of a difference between the light emission luminances of the two adjacent backlight partitions is greater than a target threshold, adjusting the light emission luminance of the at least one of the two adjacent backlight partitions.

12. The method according to claim 1, wherein the adjacent backlight partitions of the center backlight partition are: backlight partitions adjacent to the center backlight partition in eight directions of the center backlight partition.

13. A backlight controller for a display device, wherein the backlight controller comprises: a processor and a storage medium;

wherein the storage medium is configured to store at least one computer instruction executable by the processor, the at least one computer instruction, when executed by the processor, enabling the processor to perform the method for controlling the backlight of the display device as defined in claim 1.

14. A non-transitory storage medium, storing thereon at least one computer instruction executable by a processor; wherein the at least one computer instruction, when executed by the processor, enables the processor to perform the method for controlling the backlight of the display device as defined in claim 1.

15. A backlight controller for a display device, the display device further comprising: a display panel and a backlight module, wherein the display panel comprises a plurality of display partitions, and the backlight module comprises a plurality of backlight partitions one-to-one corresponding to the plurality of display partitions;

the backlight controller comprising:

a first identifying module, configured to identify a light emission luminance of each backlight partition in the backlight module according to display luminances the plurality of display partitions;

a first adjusting module, configured to, by taking a backlight partition with the highest luminance in the plurality of backlight partitions as a center backlight partition, perform an adjustment process, wherein the adjustment process comprises:

when the adjacent backlight partitions of the center backlight partition comprise a partition to be adjusted and an absolute value of a difference between the light emission luminance of the center backlight partition and that of the partition to be adjusted is greater than the target threshold, adjusting the light emission luminance of the partition to be adjusted, to decrease the absolute value of the difference between the light emission luminance of the center backlight partition and that of the partition to be adjusted; wherein when the difference between the luminance of the center backlight partition and that of the partition to be adjusted is greater than the target threshold, adjusting the luminance of the partition to be adjusted to a difference between the light emission luminance of the center backlight partition and the threshold value; and when the difference between the light emission luminance of the center backlight partition and that of the partition to be adjusted is less than or equal to the target threshold, and the difference between the light emission luminance of the partition to be adjusted and that of the center backlight partition is greater than the threshold value, adjusting the light emission luminance of the partition to be adjusted to a sum of the light emission luminance of the center backlight partition and the threshold value;

when, after the light emission luminance is adjusted, the difference between the light emission luminance of at least one of the partition to be adjusted and a non-zero minimum luminance is greater than the target threshold, updating the center backlight partition to the partition to be adjusted, and repeating the adjustment process until the difference between the light emission luminance of each partition of the partition to be adjusted, after the light emission luminance is adjusted, and the non-zero minimum luminance is less than or equal to the target threshold, wherein the non-zero minimum luminance is; a non-zero minimum luminance of the light emission luminances of the plurality of backlight partitions before the light emission luminance of the at least one of the two adjacent backlight partitions is adjusted; and a control module, configured to control, after the light emission luminance is adjusted, light-emitting of each of the backlight partitions.

16. A display device, comprising: a display panel, a backlight module, and a backlight controller; wherein the backlight controller is the backlight controller for the display device as defined in claim 15.

* * * * *